US010239199B2

(12) United States Patent
Mathis

(10) Patent No.: US 10,239,199 B2
(45) Date of Patent: Mar. 26, 2019

(54) UTENSIL SHELF

(71) Applicant: Nathaniel Mathis, District Heights, MD (US)

(72) Inventor: Nathaniel Mathis, District Heights, MD (US)

( * ) Notice: Subject to any disclaimer, the term of this patent is extended or adjusted under 35 U.S.C. 154(b) by 171 days.

(21) Appl. No.: 15/530,558

(22) Filed: Jan. 30, 2017

(65) Prior Publication Data

US 2018/0141205 A1 May 24, 2018

Related U.S. Application Data

(60) Provisional application No. 62/497,562, filed on Nov. 23, 2016.

(51) Int. Cl.

| | |
|---|---|
| ***A47B 57/10*** | (2006.01) |
| ***B25H 3/00*** | (2006.01) |
| ***B25H 3/04*** | (2006.01) |
| ***B25H 3/02*** | (2006.01) |

(52) U.S. Cl.

CPC ..... *B25H 3/04* (2013.01); *A47B 57/10* (2013.01); *B25H 3/025* (2013.01)

(58) Field of Classification Search

CPC ..... A47B 57/10; B25H 3/025; B25H 3/04; B25H 3/06

USPC ..... 206/338–347, 372, 373, 459.5; 211/70.1, 211/70.6; D6/555, 567, 574

See application file for complete search history.

(56) References Cited

U.S. PATENT DOCUMENTS

| | | | | | |
|---|---|---|---|---|---|
| 3,269,550 | A * | 8/1966 | Marcus | B25H 3/04 | 211/70.6 |
| D260,830 | S * | 9/1981 | Trouba | D6/552 | |
| 4,531,645 | A * | 7/1985 | Tisbo | A47F 5/02 | 211/126.15 |
| D340,606 | S * | 10/1993 | Hubbard | D6/567 | |
| 5,379,885 | A * | 1/1995 | Chen | B25H 3/04 | 206/216 |
| D393,543 | S * | 4/1998 | Wilkening | D3/313 | |
| 5,743,416 | A * | 4/1998 | Yemini | B25H 3/04 | 211/70.6 |
| D394,775 | S * | 6/1998 | Anderson | D6/574 | |
| 6,105,768 | A * | 8/2000 | Brown | B25H 3/04 | 206/373 |
| D478,235 | S * | 8/2003 | Gruskin | D6/574 | |
| 8,118,162 | B1 * | 2/2012 | McEwin | B25H 3/04 | 206/338 |
| 8,127,965 | B1 * | 3/2012 | Miller | B25H 3/04 | 206/373 |

(Continued)

FOREIGN PATENT DOCUMENTS

| | | | | |
|---|---|---|---|---|
| DE | 2549554 A1 * | 5/1977 | ..... | B25H 3/04 |
| DE | 29712886 U1 * | 11/1997 | ..... | B25H 3/04 |

*Primary Examiner* — Joshua E Rodden

(57) ABSTRACT

A Utensil Shelf for storing, organizing, and making available space for anyone that uses some type of small instruments. The utensil shelf is a revolving quadrilateral structure that has four sides with inserts that hold removable shelves in place. The inserts help the shelves to slide in and out easily, as well as having uniquely designed handles that are attached to the removable shelves. The removable shelves can be lowered or raised depending on the need for space. A top platform of the utensil shelf has twenty one uniquely spaced openings/holes that can be used to store or to easily remove the small instruments for use. The utensil shelf additionally includes a swivel base.

4 Claims, 1 Drawing Sheet

(56) References Cited

U.S. PATENT DOCUMENTS

| | | | | |
|---|---|---|---|---|
| D674,631 | S * | 1/2013 | Blanc | D6/707.22 |
| 9,585,476 | B2 * | 3/2017 | Swisher | B25H 1/00 |
| 2006/0102569 | A1 * | 5/2006 | Laga | A47F 5/0807 211/70.6 |
| 2018/0290291 | A1 * | 10/2018 | Wright | B25H 7/04 |

* cited by examiner

UTENSIL SHELF

BACKGROUND OF THE INVENTION

My invention came about when I misplaced a gadget and the idea for a utensil shelf for anyone that uses some type of small instruments was born.

BRIEF SUMMARY OF THE INVENTION

The Utensil Shelf is a handy shelf that makes it easy to store, view, and retrieve quickly the implements needed at that time. The Utensil Shelf was designed for anyone that uses some type of small instruments. The advantage of the Utensil Shelf is to be able to find your instruments, implements, or gadgets, when needed.

DETAILED DESCRIPTION

Figure 1:
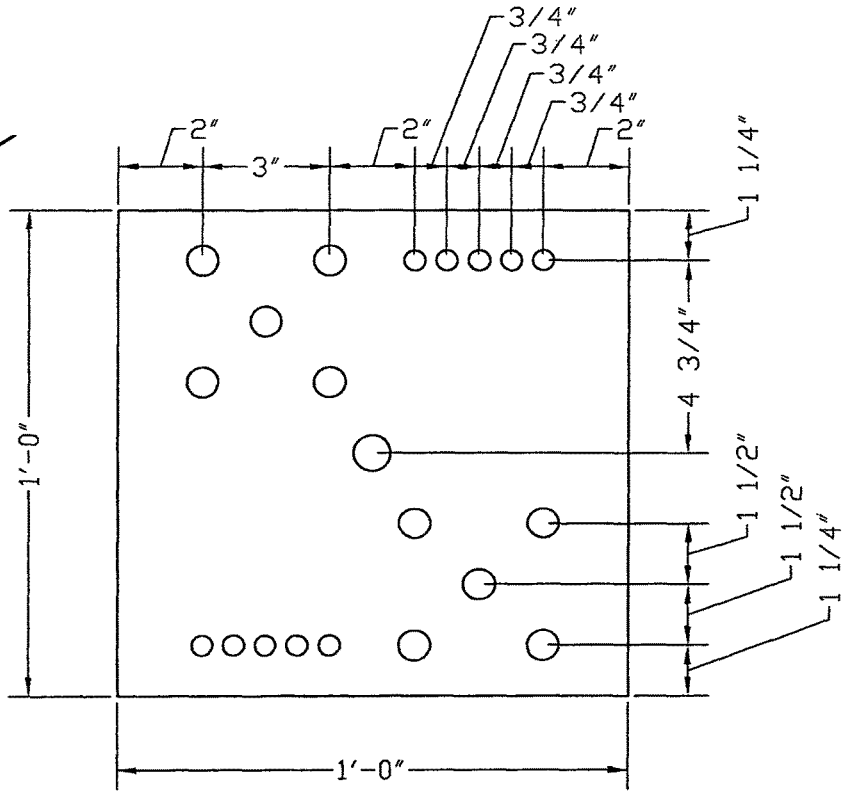
FIG. 1 is a top view of the utensil shelf
Figure 2:
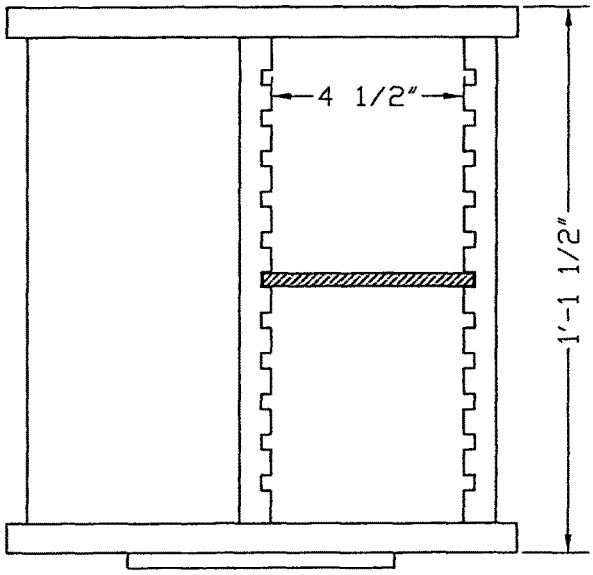
FIG. 2 is a side view of the utensil shelf.

A utensil shelf 1 has a body in the form of a revolving quadrilateral structure that has four sides with inserts 2 that hold removable shelves 3 in place. A top of the utensil shelf has a top platform 4 which is designed with twenty one openings/holes 5 that can be used to store or to easily remove an instrument for use. A bottom of the utensil shelf 1 has a swivel base 6 helps to rapidly find the instruments, implements, or gadgets.

The inserts 2 also help the shelves 3 to slide in and out easily, as well as have uniquely designed handles that are attached to the removable shelves 3. The removable shelves 3 can be lowered or raised depending on the need for space.

The top platform 4 is a square shaped platform having the twenty one openings/holes 5 spaced out in a specific manner as shown in FIG. 1. Specifically, the top platform 4 has one of the openings 5 forming a center hole, a first group of five of the openings 5 forming an x-shaped formation on a top left of the top platform 4 when viewed from above as seen in FIG. 1, a second group of five of the openings 5 forming an x-shaped formation on a bottom right of the top platform 4 when viewed from above as seen in FIG. 1, a third group of five of the openings 5 which are linearly aligned and located adjacent a first side of the top platform 4 on a top right of the top platform 4 when viewed from above as seen in FIG. 1, and a fourth group of five of the openings 5 which are linearly aligned and located adjacent a second side of the top platform 4 on a bottom left of the top platform 4 when viewed from above as seen in FIG. 1.

The third group of five linearly aligned openings 5 being linearly aligned with two of the five openings 5 of the first group of five openings 5, and the fourth group of five linearly aligned openings 5 being linearly aligned with two of the five openings 5 of the second group of five linearly aligned opening 5. Three openings 5 from the first group of five opening 5 being linearly aligned with the center opening 5 and three openings 5 of the second group of five openings 5.

The first and second groups of five openings 5 being equidistantly spaced from one another, respectively. The third and fourth groups of openings 5 being equidistantly spaced from another, respectively. The equidistantly spaced openings 5 of the first and second groups of openings 5 not matching spacing of the equidistantly spaced openings 5 of the third and fourth groups of openings 5.

The invention claimed is:

1. A utensil shelf comprising:

a top platform in the form of a planar, square shaped platform having twenty one openings, the top platform has one of the openings forming a center hole, a first group of five of the openings forming an x-shaped formation on a top left of the top platform when viewed from above, a second group of five of the openings forming an x-shaped formation on a bottom right of the top platform when viewed from above, a third group of five of the openings being linearly aligned and located adjacent a first side of the top platform on a top right of the top platform when viewed from above, and a fourth group of five of the openings being linearly aligned and located adjacent a second side of the top platform on a bottom left of the top platform when viewed from above;

the third group of five linearly aligned openings being linearly aligned with two of the five openings of the first group of five openings, and the fourth group of five linearly aligned openings being linearly aligned with two of the five openings of the second group of five linearly aligned openings, three openings from the first group of five opening being linearly aligned with the center opening and three openings of the second group of five openings; and the first and second groups of five openings being equidistantly spaced from one another, respectively, the third and fourth groups of openings being equidistantly spaced from another, respectively, and the equidistantly spaced openings of the first and second groups of openings not matching spacing of the equidistantly spaced openings of the third and fourth groups of openings.

2. The utensil shelf of claim 1, further comprising a body underneath the top platform, the body being in the form of a revolving quadrilateral structure that has four sides with inserts for holding removable shelves in place.

3. The utensil shelf of claim 2, further comprising a plurality of removable shelves located in the body.

4. The utensil shelf of claim 2, further comprising a swivel base located beneath the body.

* * * * *